US009279239B2

(12) United States Patent
Feng

(10) Patent No.: US 9,279,239 B2
(45) Date of Patent: Mar. 8, 2016

(54) MANUAL AND AUTOMATIC INTEGRATED FAUCET

(71) Applicant: Weiquan Feng, Jiangmen (CN)

(72) Inventor: Weiquan Feng, Jiangmen (CN)

( * ) Notice: Subject to any disclaimer, the term of this patent is extended or adjusted under 35 U.S.C. 154(b) by 179 days.

(21) Appl. No.: 14/224,114

(22) Filed: Mar. 25, 2014

(65) Prior Publication Data

US 2015/0159352 A1 Jun. 11, 2015

(30) Foreign Application Priority Data

Dec. 10, 2013 (CN) ..... 2013 1 0664962
Dec. 10, 2013 (CN) ..... 2013 1 0667012

(51) Int. Cl.
*E03C 1/05* (2006.01)

(52) U.S. Cl.
CPC ..... *E03C 1/057* (2013.01); *Y10T 137/86389* (2015.04)

(58) Field of Classification Search
CPC ..... E03C 1/057; E03C 1/055; E03C 1/05; Y10T 137/86389; Y10T 137/9464
USPC ..... 251/129.04; 4/623; 137/801, 624.11
See application file for complete search history.

(56) References Cited

U.S. PATENT DOCUMENTS 6,003,170 A * 12/1999 Humpert ..... E03C 1/057 4/623
6,619,320 B2 * 9/2003 Parsons ..... E03C 1/05 137/624.11
6,962,168 B2 * 11/2005 McDaniel ..... E03C 1/055 137/624.11
2001/0022352 A1 * 9/2001 Rudrich ..... H03K 17/962 251/129.04
2005/0151101 A1 * 7/2005 McDaniel ..... E03C 1/057 251/129.04
2006/0202142 A1 * 9/2006 Marty ..... E03C 1/055 251/129.04
2009/0039176 A1 * 2/2009 Davidson ..... E03C 1/0404 239/67
2010/0044604 A1 * 2/2010 Burke ..... E03C 1/057 251/129.04
2010/0108165 A1 * 5/2010 Rodenbeck ..... E03C 1/057 137/801

FOREIGN PATENT DOCUMENTS

CN 101886714 A 11/2010
CN 201715072 U 1/2011
CN 102705542 A 10/2012

* cited by examiner

*Primary Examiner* — John Bastianelli
(74) *Attorney, Agent, or Firm* — Schmeiser, Olsen & Watts, LLP

(57) ABSTRACT

A manual and automatic integrated faucet, comprising a faucet main body, a water outlet component, a handle, a handle switch, a displacement sensing element, a touch sensing element, an action sensing element, a control element and an electromagnetic valve; the water outlet component is connected with the faucet main body at one end, and provided with a water outlet at the other end; the handle switch is arranged on the faucet main body, and the electromagnetic valve is arranged on a water outlet passage of the faucet; the water outlet is controlled to let water out by simultaneously turning on the handle switch and opening the electromagnetic valve; and manual and automatic integration can be achieved by applying the handle switch, a touch sensing switch, a displacement switch, an infrared sensing switch and a timer to one faucet.

9 Claims, 6 Drawing Sheets

MANUAL AND AUTOMATIC INTEGRATED FAUCET

CROSS-REFERENCE TO RELATED APPLICATIONS

This application claims priority to CN Patent Application 201310667012.5 filed on Dec. 10, 2013 and CN Patent Application 201310664962.2 filed on Dec. 10, 2013, both of which the entire contents are hereby incorporated by reference.

FIELD OF TECHNOLOGY

The present invention relates to a faucet, in particular to a manual and automatic integrated faucet.

BACKGROUND

Currently, faucets in the markets have various forms, and are largely divided into manual and automatic types, wherein a manual faucet has a mechanical valve opened or closed by human strength; and automatic faucets include inductive faucets, touch faucets, etc., and receive trigger information by a sensing element or a touch sensing element to control the opening or closing of an electromagnetic valve. These automatic faucets are widely used in public locations, such as canteens, air ports, hospitals and hotels, as well as in private locations, such as at home. The existing inductive faucets are very suitable to be used in public locations because the opening of the faucets can be achieved without contact, and potential sanitary safety problem can be effectively eliminated. However, faucets in such an inductive water outflow mode become too monotonous and do not work well in private locations, such as at home, and in places with large water consumption or places needing continuous use of water, such as in medial cleaning rooms, food factories and catering chain enterprises. A touch sensing element of a touch faucet is usually arranged on the whole exposed main body of the faucet, and the main body is insulated from a mounting countertop. However, in this way of arrangement, it is likely to cause touching of a switch and continuous opening of an electromagnetic valve due to water splashing on the countertop or interference of other factors.

Meanwhile, if a touch sensing element or an infrared sensing element outside the faucet is damaged and cannot sense external trigger information, use of water can be seriously affected, and the maintenance procedure is complicated. Also, such inductive faucets have various types; and if installed and used at home, the faucets are difficult to use conveniently by old people or children in general, and they need to continuously grasp using methods of various inductive faucets, thus affecting the use of water by old people or children.

SUMMARY

An aspect of the present invention is to overcome the shortcomings and deficiencies of the prior art, and provide a manual and automatic integrated faucet.

The manual and automatic integrated faucet comprises a faucet main body, a water outlet component, a handle, a handle switch, a touch sensing element, a first action sensing element, a control element and an electromagnetic valve, wherein the water outlet component is connected with the faucet main body at one end, and provided with a water outlet at the other end; the handle switch is arranged on a water outlet passage; the handle is arranged on the faucet main body, and controls the handle switch to be turned on or off; the electromagnetic valve is arranged on the water outlet passage; the touch sensing element and the first action sensing element sends a trigger signal to the control element; and the control element controls the opening and closing of the electromagnetic valve;

the touch sensing element transmits a touch signal to the control element; in the case that the electromagnetic valve is closed, the control element controls the opening of the electromagnetic valve; and in the case that the electromagnetic valve is open, the touch signal is not processed;

a sensing area of the first action sensing element is arranged at the water outlet; when sensing that an object is entering the sensing area, the first action sensing element sends a first trigger signal to the control element; in the case that the electromagnetic valve is closed, the control element controls the opening of the electromagnetic valve; in the case that the electromagnetic valve is open, the control element does not process the first trigger signal; and when the first action sensing element senses that an object is departing from the sensing area, the first action sensing element sends a second trigger signal to the control element, and the control element controls the closing of the electromagnetic valve.

Compared with the prior art, the present invention combines and applies the handle switch, the touch sensing element and the first action sensing element to one faucet, and the water outflow state of the faucet is controlled by the handle switch and the electromagnetic valve simultaneously, to achieve manual and automatic integration. Meanwhile, the opening and closing of the electromagnetic valve is controlled by the touch sensing element and the first action sensing element, to achieve diversity of switches of the faucet and facilitate use by different groups of people.

As a further embodiment, the faucet also comprises a second action sensing element; a sensing area of the second action sensing element is isolated from the sensing area of the first action sensing element; when sensing that an object is entering the sensing area of the second action sensing element, the second action sensing element sends a sensing signal to the control element; in the case that the electromagnetic valve is closed, the control element controls the opening of the electromagnetic valve; and in the case that the electromagnetic valve is open, the control element controls the closing of the electromagnetic valve.

As a further embodiment, the faucet also comprises a displacement sensing element; the water outlet component is movably connected with the faucet main body at one end through a conduit; the conduit slides in the faucet main body, to control the contact and separation between the water outlet component and the faucet main body; the displacement sensing element converts the separation between the water outlet component and the faucet main body to an opening signal and transmits the signal to the control element to control the electromagnetic valve to be opened; and the displacement sensing element converts the contact between the water outlet component and the faucet to a closing signal and transmits the signal to the control element to control the electromagnetic valve to be closed. The opening and closing of the electromagnetic valve is controlled by the contact and separation between the water outlet component and the faucet main body through the displacement sensing element, to facilitate use.

As a further embodiment, the handle is insulated from the faucet main body; and the touch sensing element is arranged on the handle, and exposed to the outer surface of the handle. It is possible to touch the sensing element and at the same time open the electromagnetic valve while turning on the handle switch, so that the water outlet of the faucet main body lets water out. As a further embodiment, the first action sensing element is an infrared sensing element, and the first action sensing element is arranged at the periphery of the water outlet of the water outlet component; and the second action sensing element is an infrared sensing element, and the second action sensing element is arranged on the outer side face of the water outlet component. The second infrared sensing element is arranged on the outer surface of the water outlet component, to control the opening and closing of the electromagnetic valve. The first infrared sensing element is arranged at the periphery of the water outlet, so that the electromagnetic valve is automatically opened and directly lets water out when a human hand or other object is at the water outlet, thus ensuring that the faucet is convenient to use.

As a further embodiment, the faucet also comprises a timer electrically connected with the control element; in the case that the electromagnetic valve is closed, when the control element receives the signal from the touch sensing element, the control element controls the opening of the electromagnetic valve and controls the timer to perform timing; and when the accumulative time of the timer reaches a set value, the timer feeds back a signal to the control element, which controls the closing of the electromagnetic valve, and at the same time the timer is automatically reset;

in the case that the electromagnetic valve is open, when the control element receives the touch signal from the touch sensing element, the control element controls the timer to be reset and restart timing; and when the accumulative time of the timer reaches a set value, the timer feeds back a signal to the control element, which controls the closing of the electromagnetic valve, and at the same time the timer is automatically reset.

By adding the function of timing for the opening time when the touch sensing element transmits the opening signal to control the opening of the electromagnetic valve, waste of water resources is avoided. Moreover, the timer is reset after the electromagnetic valve is closed, to ensure that the time of timing for each opening is the same.

As a further embodiment, the control element receives the first trigger signal from the first infrared sensing element, and in the case that the electromagnetic valve is closed, the control element controls the electromagnetic valve to be opened, and at the same time controls the timer to perform timing; and when the accumulative time of the timer reaches a set value, the timer feeds back a signal to the control element, which controls the closing of the electromagnetic valve, and at the same time the timer is automatically reset;

in the case that the electromagnetic valve is open, when the control element receives the first trigger signal from the first infrared sensing element, the control element controls the timer to be reset and restart timing; and when the accumulative time of the timer reaches a set value, the timer feeds back a signal to the control element, which controls the closing of the electromagnetic valve, and at the same time the timer is automatically reset. By adding the function of timing for the opening time when the first infrared sensing element transmits the opening signal to control the opening of the electromagnetic valve, waste of water resources is avoided. Moreover, the timer is reset after the electromagnetic valve is closed, to ensure that the time of timing for each opening is the same.

As a further embodiment, when the second infrared sensing element senses that an object is entering the sensing area of the second infrared sensing element, the second infrared sensing element transmits a sensing signal to the control element; in the case that the electromagnetic valve is closed, the electromagnetic valve is controlled to be opened, and at the same time the timer is controlled to perform timing; and when the accumulative time of the timer reaches a set value, a signal is fed back to the control element, which controls the closing of the electromagnetic valve, and at the same time the timer is automatically reset. By adding the function of timing for the opening time when the second infrared sensing element transmits the opening signal to control the opening of the electromagnetic valve, waste of water resources is avoided. Moreover, the timer is reset after the electromagnetic valve is closed, to ensure that the time of timing for each opening is the same.

As a further embodiment, the displacement sensing element transmits the opening signal to the control element, and in the case that the electromagnetic valve is closed, the control element controls the opening of the electromagnetic valve, and at the same time the control element controls the timer to start timing; and when the timer reaches a set time, the timer feeds back information to the control element, which controls the closing of the electromagnetic valve, and the timer is automatically reset;

in the case that the electromagnetic valve is open, when the control element receives the opening signal from the displacement sensing element, the control element controls the timer to be reset and restart timing; and when a set time of the timer is reached, the timer feeds back information to the control element, which controls the closing of the electromagnetic valve, and at the same time the timer is automatically reset;

in the case that the electromagnetic valve is open, when the control element receives the closing signal from the displacement sensing element, the control element directly controls the closing of the electromagnetic valve.

By adding the function of timing for the opening time when the displacement sensing element transmits the opening signal to control the opening of the electromagnetic valve, waste of water resources is avoided. Moreover, the timer is reset after the electromagnetic valve is closed, to ensure that the time of timing for each opening is the same.

As a further embodiment, the faucet also comprises a hose and a control line; the control line is electrically connected with the touch sensing element, the first infrared sensing element, the second infrared sensing element and the displacement sensing element respectively; and the control line is arranged inside the hose. The hose and the control line are connected with the faucet main body to form a whole, and the first infrared sensing element, the second infrared sensing element, the displacement sensing element and the water outlet component form a movable integrated component, so that the faucet is very convenient to use.

As a further embodiment, the time value set for the timer is preferably 60 seconds.

BRIEF DESCRIPTION

To understand the present invention more clearly, specific implementation ways of the present invention will be described in conjunction with the accompanying drawings, wherein.

DETAILED DESCRIPTION

Embodiment 1

Figure 1:
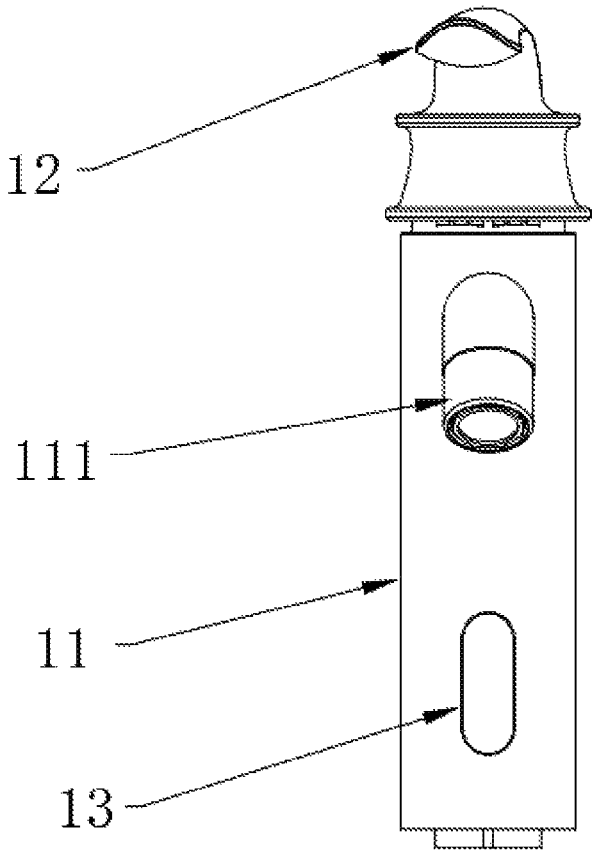
FIG. 1 is a structure diagram of a manual and automatic integrated faucet of embodiment 1 of the present invention.

Please refer to FIG. 1, which is a structure diagram of a manual and automatic integrated faucet of embodiment 1 of the present invention. The manual and automatic integrated faucet includes a faucet main body 11, a water outlet component, a handle 12, a handle switch, a touch sensing element, a first action sensing element 13, a control element, a timer and an electromagnetic valve.

Specifically, in the embodiment, the first action sensing element 13 is an infrared sensing element.

The water outlet component is arranged on the faucet main body 11 at one end, and provided with a water outlet 111 at the other end; the handle 12 is arranged on the faucet main body 11, and the handle switch is arranged on a water outlet passage of the faucet main body; and the electromagnetic valve is arranged on the water outlet passage of the faucet main body 11. The handle switch is controlled by the handle 12 to be turned on or off; and the water outlet 111 is controlled to let water out by simultaneously turning on the handle switch and opening the electromagnetic valve.

Further, the handle 12 is insulated from the faucet main body 11; and the touch sensing element is arranged on the handle 12, and exposed to the outer surface of the whole handle 12. A sensing area of the first action sensing element 13 is located at the water outlet 111; and in the embodiment, the first action sensing element 13 is located below the water outlet 111.

The touch sensing element transmits a touch signal to the control element, and the control element controls the opening and closing of the electromagnetic valve, and at the same time controls the operation of the timer. The first action sensing element transmits a sensing signal to the control element, and the control element controls the opening and closing of the electromagnetic valve, and at the same time controls the operation of the timer.

Figure 2:
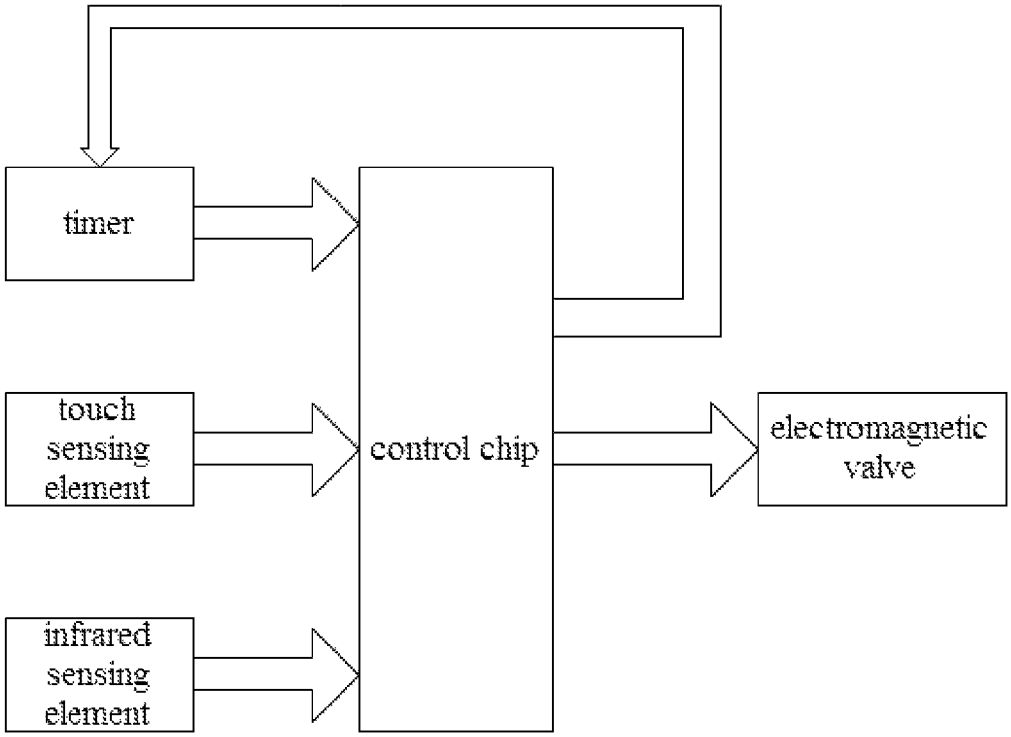
FIG. 2 is a schematic diagram of detection signal transmission of embodiment 1 of the present invention.

Please refer to FIG. 2, which is a schematic diagram of detection signal transmission of embodiment 1 of the present invention.

The touch sensing element and the first action sensing element sends trigger information to the control element, and the control element controls the opening and closing of the electromagnetic value;

the touch sensing element transmits a touch signal to the control element when touch time reaches 0.5 second; in the case that the electromagnetic valve is closed, the control element controls the opening of the electromagnetic valve; and in the case that the electromagnetic valve is open, the control element does not process the touch signal;

the sensing area of the first action sensing element is arranged at the water outlet; when sensing that an object is entering the sensing area, the first action sensing element sends a first trigger signal which is transmitted to the control element; in the case that the electromagnetic valve is closed, the control element controls the opening of the electromagnetic valve; in the case that the electromagnetic valve is open, the control element does not process the first trigger signal; and when the first action sensing element senses that an object is departing from the sensing area, it sends a second trigger signal to the control element, and the control element controls the closing of the electromagnetic valve.

The timer is used for controlling the opening time of the electromagnetic valve; in the case that the electromagnetic valve is closed, when the control element receives a signal from the touch sensing element, it controls the opening of the electromagnetic valve and controls the timer to perform timing; and when the accumulative time of the timer reaches a set value, the timer feeds back a signal to the control element, which controls the closing of the electromagnetic valve, and at the same time the timer is automatically reset.

In the case that the electromagnetic valve is open, when the control element receives a signal from the touch sensing element, it controls the timer to be reset and restart timing; and when the accumulative time of the timer reaches a set value, the timer feeds back a signal to the control element, which controls the closing of the electromagnetic valve, and at the same time the timer is automatically reset.

When the control element receives the first trigger signal from the infrared sensing element in the case that the electromagnetic valve is closed, it controls the timer to perform timing; and when the accumulative time of the timer reaches a set value, the timer feeds back a signal to the control element, which controls the closing of the electromagnetic valve, and at the same time the timer is automatically reset.

In the case that the electromagnetic valve is open, when the control element receives the first trigger signal, the timer is reset and restarts timing, and when the accumulative time of the timer reaches a set value, the timer feeds back a signal to the control element, which controls the closing of the electromagnetic valve, and at the same time the timer is automatically reset.

A preferred timing opening time is 60 seconds in the embodiment.

Figure 3:
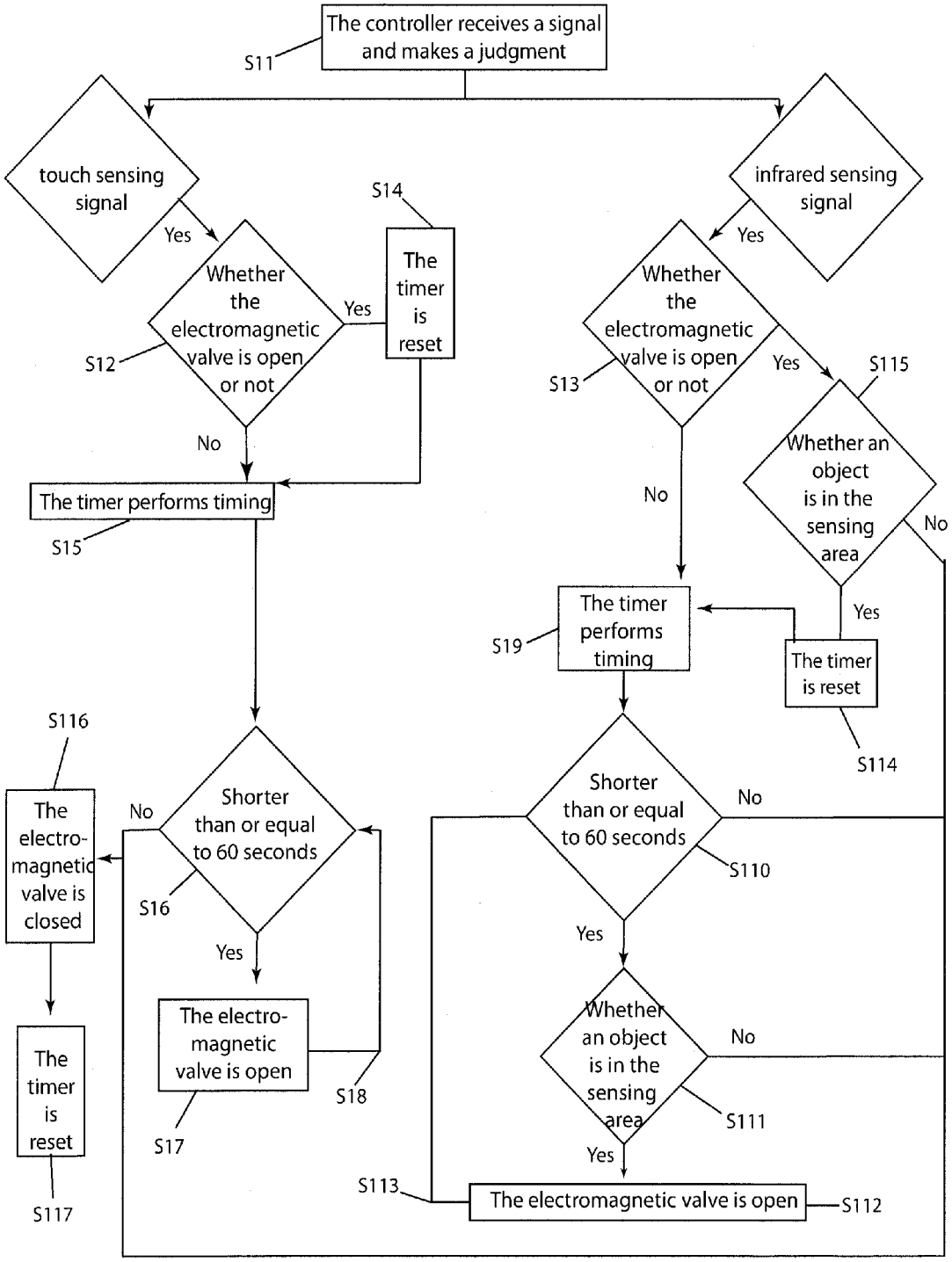
FIG. 3 is a signal processing flow diagram of a control element of embodiment 1 of the present invention.

A specific signal processing flow of the manual and automatic integrated faucet of the present invention is described below in detail. Please refer to FIG. 3, which is a signal processing flow diagram of the control element of embodiment 1 of the present invention.

S11: judging a trigger signal by the control element, and executing step S12 when the control element determines that the trigger signal is a touch sensing signal; and executing step S13 when the control element determines that the trigger signal is an infrared sensing signal;

S12: judging the state of the electromagnetic valve, and executing step S14 when the electromagnetic valve is in an open state; and executing step S15 when the electromagnetic valve is in a closed state;

S13: judging the state of the electromagnetic valve, and executing step S114 when the electromagnetic valve is in an open state; and executing step S19 when the electromagnetic valve is in a closed state;

S14: resetting the timer, and executing step S15;

S15: starting timing by the timer;

S16: judging the accumulative time of the timer, and executing step S116 when the accumulative time is longer than 60 seconds; and executing step S17 when the accumulative time is shorter than or equal to 60 seconds;

S17: opening the electromagnetic valve;

S18: returning to step S16, and continuing to judge the accumulative time;

S19: starting timing by the timer;

S110: judging the accumulative time of the timer, and executing step S115 when the accumulative time is longer than 60 seconds; and executing step S111 when the accumulative time is shorter than or equal to 60 seconds;

S111: judging the state of the infrared sensing area, and executing step S112 when sensing that an object is entering the infrared sensing area; and executing step S116 when sensing that an object is departing from the infrared sensing area;

S112: opening the electromagnetic valve;

S113: returning to step S110, and continuing to judge the accumulative time;

S114: judging the state of the infrared sensing area, and executing step S115 when an object is entering the infrared sensing area; and executing step S116 when it is sensed in the infrared sensing area that an object is departing from the infrared sensing area;

S115: resetting the timer, and executing step S19;

S116: closing the electromagnetic valve; and

S117: resetting the timer.

Embodiment 2

Figure 4:
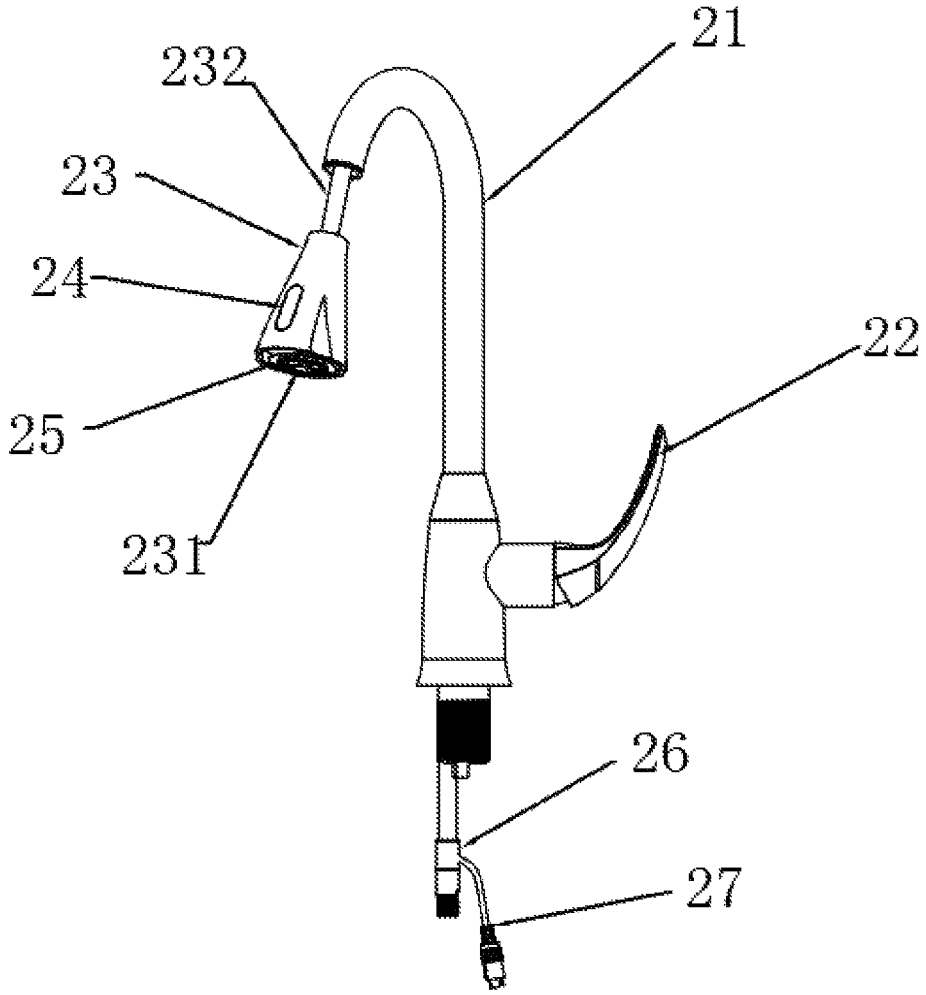
FIG. 4 is a structure diagram of a manual and automatic integrated faucet of embodiment 2 of the present invention.

Please refer to FIG. 4, which is a structure diagram of a manual and automatic integrated faucet of embodiment 2 of the present invention. The manual and automatic integrated faucet of the present invention includes a faucet main body 21, a handle 22, a handle switch, a water outlet component 23, a second action sensing element 24, a first action sensing element 25, a touch sensing element, a hose 26, a control line 27, a displacement sensing element, a control element, a timer and an electromagnetic valve.

Specifically, the first action sensing element 25 is an infrared sensing element; and the second action sensing element 24 is an infrared sensing element.

The handle 22 is arranged on the faucet main body 21, and controls the handle switch to be turned on or off; the electromagnetic valve is arranged on a water outlet passage; and a water outlet 231 is controlled to let water out by simultaneously turning on the handle switch and opening the electromagnetic valve.

The water outlet component 23 is provided with a conduit 232 at one end, and a water outlet 231 at the other end. The water outlet component 23 is movably connected with the faucet main body 21 at one end through the conduit 232; and the conduit 232 slides in the faucet main body 21, to control the contact and separation between the water outlet component 23 and the faucet main body 21.

The control line 27 is electrically connected with the touch sensing element, the first infrared sensing element 23, the second infrared sensing element 24 and the displacement sensing element respectively; and the control line is arranged inside the hose 26.

Further, the handle 22 is insulated from the faucet main body 21; and the touch sensing element is arranged on the handle 22, and exposed to the outer surface of the handle.

A sensing area of the first infrared sensing element 25 is located at the water outlet. In this embodiment, the first infrared sensing element 25 is located at the periphery of the water outlet 231 of the water outlet component 23. The second action sensing element 24 is an infrared sensing element; a sensing area of the second infrared sensing element is isolated from the sensing area of the first action sensing element; in this embodiment, the second action sensing element 24 is arranged on the outer side face of the water outlet component 23; and it is prevented that the second action sensing element and the first infrared sensing element 25 sense an object simultaneously to cause signal interference.

Figure 5:
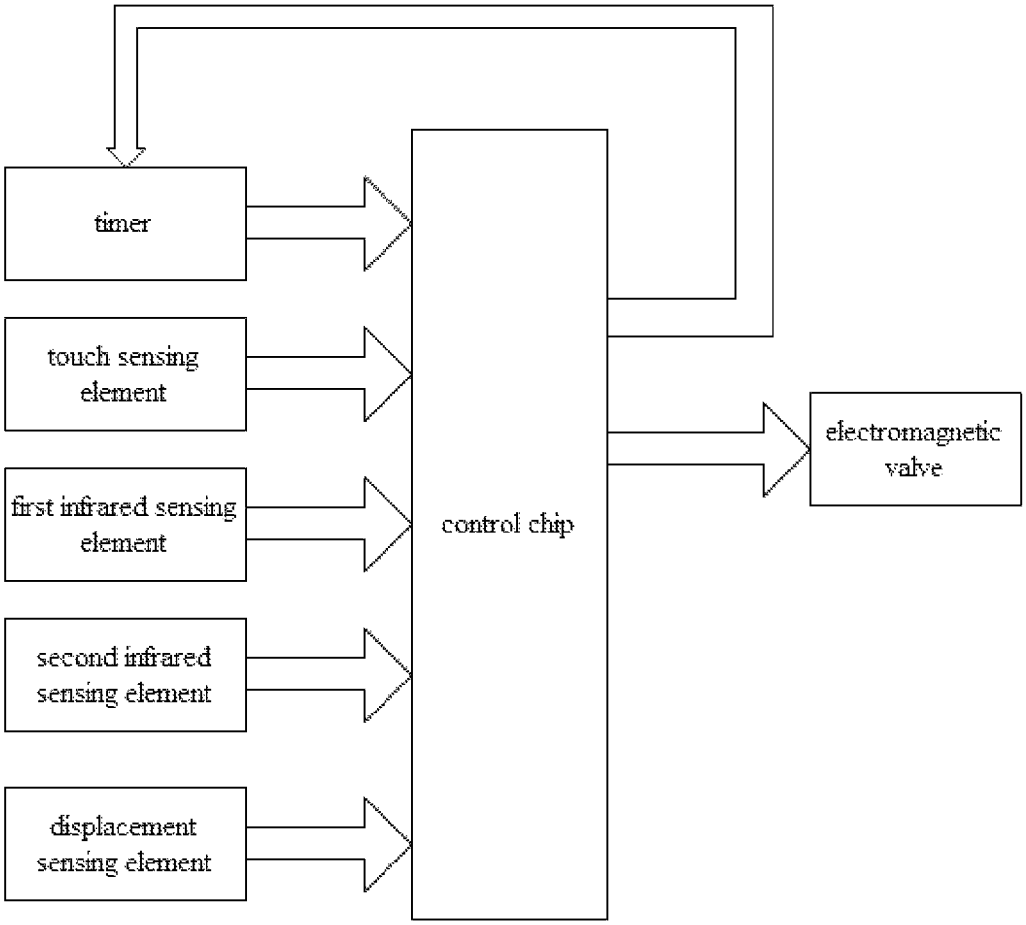
FIG. 5 is a schematic diagram of detection signal transmission of embodiment 2 of the present invention.

Please refer to FIG. 5, which is a schematic diagram of detection signal transmission of embodiment 2 of the present invention.

The touch sensing element, the first action sensing element and the second action sensing element sends trigger information to the control element, and the control element controls the opening and closing of the electromagnetic value.

When touch time reaches more than 0.5 second, the touch sensing element transmits a touch signal to the control element, and the control element controls the opening of the electromagnetic valve; at the same time the control element controls the timer to start timing; when the timer reaches a set time, the timer feeds back information to the control element, and the control element controls the closing of the electromagnetic valve; and when the electromagnetic valve is closed, the timer is reset. In the case that the electromagnetic valve is open, when the touch time of the touch sensing element reaches more than 0.5 second, the control element controls the timer to be reset and restart timing; and the electromagnetic valve remains in the open state, and when the accumulative time of the timer reaches a set value, the timer feeds back information to the control element, which controls the closing of the electromagnetic valve, and at the same time the timer is automatically reset.

When the first action sensing element senses that an object is entering the sensing area, the first action sensing element sends a first trigger signal to the control element; in the case that the electromagnetic valve is closed, the control element controls the opening of the electromagnetic valve, and at the same time controls the timer to perform timing; and when the accumulative time of the timer reaches a set value, the timer feeds back a signal to the control element, which controls the closing of the electromagnetic valve, and at the same time the timer is automatically reset.

In the case that the electromagnetic valve is open, when the control element receives the first trigger signal from the first action sensing element, the control element controls the timer to be reset and restart timing; and when the accumulative time of the timer reaches a set value, the timer feeds back a signal to the control element, which controls the closing of the electromagnetic valve, and at the same time the timer is automatically reset.

When the first action sensing element senses that an object is departing from the sensing area, it sends a second trigger signal to the control element, and the control element directly controls the closing of the electromagnetic valve.

When the second action sensing element senses that an object enters the sensing area of the second action sensing element and stays therein for more than 0.5 second, it sends a sensing signal to the control element; in the case that the electromagnetic valve is closed, the control element controls the opening of the electromagnetic valve, and at the same time controls the timer to start timing; and when the timer reaches a set value, the timer feeds back information to the control element, which controls the closing of the electromagnetic valve, and at the same time the timer is automatically reset.

In the case that the electromagnetic valve is open, when the control element receives the sensing signal from the second action sensing element, the control element directly controls the closing of the electromagnetic valve.

The displacement sensing element converts the separation between the water outlet component and the faucet main body to an opening signal, which is transmitted to the control element to control the electromagnetic valve to be opened; and the displacement sensing element converts the contact between the water outlet component and the faucet to a closing signal and transmits the signal to the control element, which controls the electromagnetic valve to be closed. The displacement sensing element transmits the opening signal to the control element, and in the case that the electromagnetic valve is closed, the control element controls the opening of the electromagnetic valve, and at the same time controls the timer to start timing; and when the timer reaches a set time, the timer feeds back information to the control element, which controls the closing of the electromagnetic valve, and the timer is automatically reset.

In the case that the electromagnetic valve is open, when the control element receives the opening signal from the displacement sensing element, the timer is reset and restarts timing; and when a set value of the timer is reached, the timer feeds back information to the control element, which controls the closing of the electromagnetic valve, and the timer is automatically reset.

In the case that the electromagnetic valve is open, when the control element receives the closing signal from the displacement sensing element, the control element directly controls the closing of the electromagnetic valve.

In this embodiment, the time set for the timer is 60 seconds.

Figure 6:
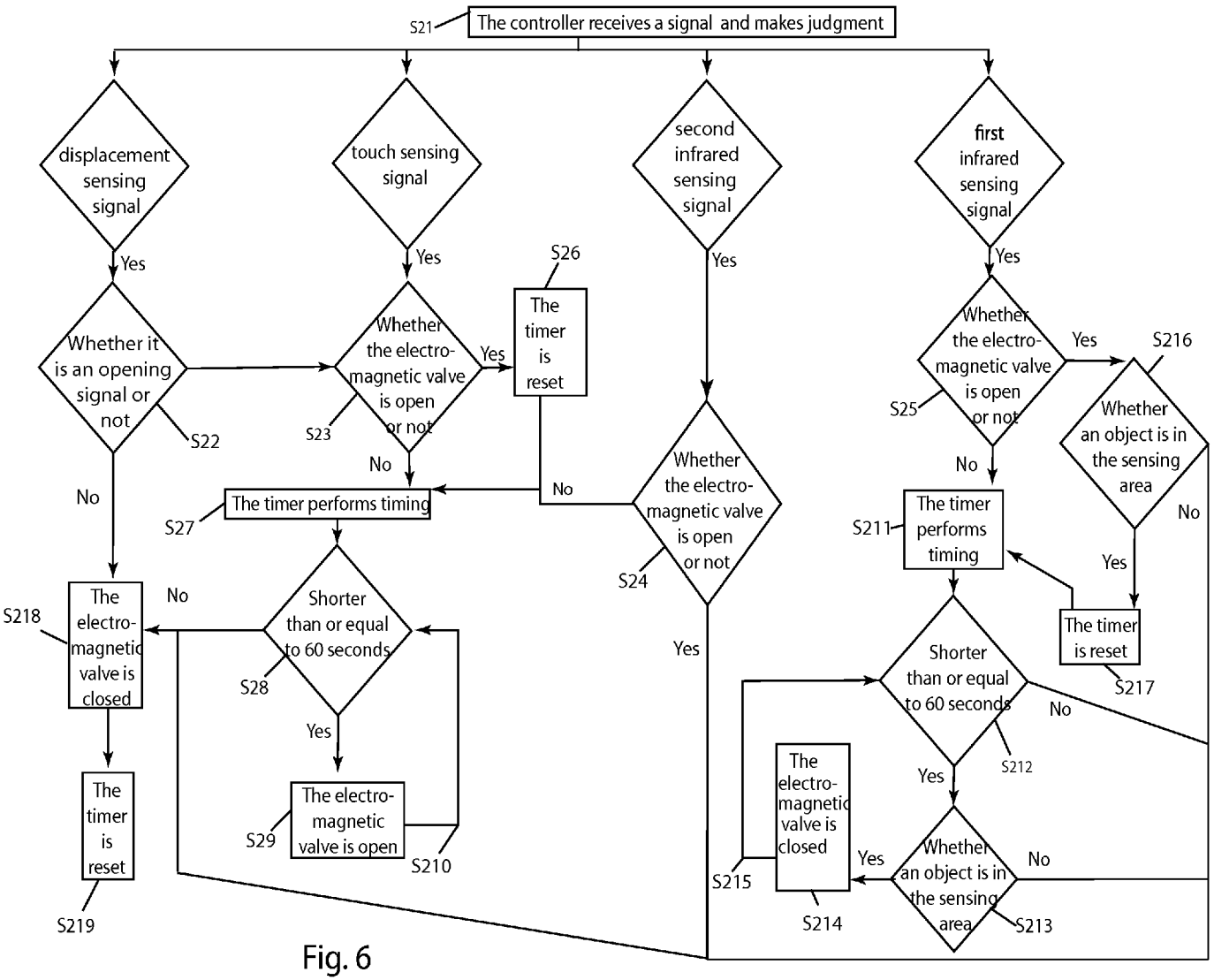
FIG. 6 is a signal processing flow diagram of a control element of embodiment 2 of the present invention.

A specific signal processing and controlling method of the manual and automatic integrated faucet of the present invention is described below in detail. Please refer to FIG. 6, which is a signal processing flow diagram of the control element of embodiment 2 of the present invention.

S21: judging a trigger signal by the control element, and executing step S22 when the control element determines that the trigger signal is a displacement sensing signal; executing step S23 when the control element determines that the trigger signal is a touch sensing signal; executing step S24 when the control element determines that the trigger signal is a second infrared sensing signal; and executing step S25 when the control element determines that the trigger signal is a first infrared sensing signal;

S22: judging the displacement sensing signal, and executing step S23 when the displacement sensing signal is an opening signal; and executing step S218 when the displacement sensing signal is a closing signal;

S23: judging the state of the electromagnetic valve, and executing step S26 when the electromagnetic valve is in an open state; and executing step S27 when the electromagnetic valve is in a closed state;

S24: judging the state of the electromagnetic valve, and executing step S218 when the electromagnetic valve is in an open state; and executing step S27 when the electromagnetic valve is in a closed state;

S25: judging the state of the electromagnetic valve, and executing step S216 when the electromagnetic valve is in an open state; and executing step S211 when the electromagnetic valve is in a closed state;

S26: resetting the timer, and executing step S27;

S27: starting timing by the timer;

S28: judging the accumulative time of the timer, and executing step S218 when the accumulative time is longer than 60 seconds; and executing step S29 when the accumulative time is shorter than or equal to 60 seconds;

S29: opening the electromagnetic valve;

S210: returning to step S28, and continuing to judge the accumulative time;

S211: starting timing by the timer;

S212: judging the accumulative time of the timer, and executing step S218 when the accumulative time is longer than 60 seconds; and executing step S213 when the accumulative time is shorter than or equal to 60 seconds;

S213: judging the state of a first infrared sensing area, and executing step S214 when an object is sensed in the first infrared sensing area; and executing step S218 when no object is sensed in the first infrared sensing area;

S214: opening the electromagnetic valve;

S215: returning to step S212, and continuing to judge the accumulative time;

S216: judging the state of a first infrared sensing area, and executing step S217 when an object is sensed in the first infrared sensing area; and executing step S218 when no object is sensed in the first infrared sensing area;

S217: resetting the timer, and executing step S211;

S218: closing the electromagnetic valve; and

S219: resetting the timer.

Compared with the prior art, the present invention implements the manual and automatic integrated faucet by combining the handle switch, the touch sensing element, the displacement sensing element, the first infrared sensing element and the second infrared sensing element. The touch sensing element is arranged on the outer surface of the handle, and while the handle switch is turned on, the touch sensing element can be triggered, and at the same time the electromagnetic valve is opened, so that the water outlet of the faucet main body lets water out. The water outflow state of the faucet can be controlled by using the touch sensing element, the first infrared sensing element, the second sensing element or the displacement sensing element, so that the faucet is more convenient to use.

Further, the opening time of the electromagnetic valve can be controlled by using the timer, thus avoiding waste of water resources due to forgetting to turn off the faucet, or continuous opening of the electromagnetic valve because external factors affect the touch sensing element or the infrared sensing element. Meanwhile, it facilitates use by old people or children at home, and is more convenient and efficient.

The present invention is not limited to the above implementation ways, and if various modifications or variations to the present invention do not depart from the spirit and scope of the present invention, the present invention is also intended to encompass these modifications and variations provided that these modifications and variations fall within the scope of the claims and equivalent technology of the present invention.

What is claimed is:

1. A manual and automatic integrated faucet, comprising a faucet main body, a water outlet component, a handle, a handle switch, a touch sensing element, a first action sensing element, a control element and an electromagnetic valve, wherein the water outlet component is connected with the faucet main body at one end, and provided with a water outlet at the other end; the handle switch is arranged on a water outlet passage; the handle is arranged on the faucet main body, and controls the handle switch to be turned on or off; the electromagnetic valve is arranged on the water outlet passage; the touch sensing element and the first action sensing element sends a trigger signal to the control element, and the control element controls the opening and closing of the electromagnetic valve; and the touch sensing element transmits a touch signal to the control element; in the case that the electromagnetic valve is closed, the control element controls the opening of the electromagnetic valve; and in the case that the electromagnetic valve is open, the touch signal is not processed; and a sensing area of the first action sensing element is arranged at the water outlet; when sensing that an object is entering the sensing area, the first action sensing element sends a first trigger signal to the control element; in the case that the electromagnetic valve is closed, the control element controls the opening of the electromagnetic valve; in the case that the electromagnetic valve is open, the control element does not process the first trigger signal; and when the first action sensing element senses that an object is departing from the sensing area, the first action sensing element sends a second trigger signal to the control element, and the control element controls the closing of the electromagnetic valve; and wherein the faucet also comprises a second action sensing element; a sensing area of the second action sensing element is isolated from the sensing area of the first action sensing element; when sensing that an object is entering the sensing area of the second action sensing element, the second action sensing element sends a sensing signal to the control element; in the case that the electromagnetic valve is closed, the control element controls the opening of the electromagnetic valve; and in the case that the electromagnetic valve is open, the control element controls the closing of the electromagnetic valve.

2. The manual and automatic integrated faucet according to claim 1, wherein the faucet also comprises a displacement sensing element; the water outlet component is movably connected with the faucet main body at one end through a conduit; the conduit slides in the faucet main body, to control the contact and separation between the water outlet component and the faucet main body; the displacement sensing element converts the separation between the water outlet component and the faucet main body to an opening signal and transmits the signal to the control element to control the electromagnetic valve to be opened; and the displacement sensing element converts the contact between the water outlet component and the faucet to a closing signal and transmits the signal to the control element to control the electromagnetic valve to be closed.

3. The manual and automatic integrated faucet according to claim 1, wherein the handle is insulated from the faucet main body; and the touch sensing element is arranged on the handle, and exposed to the outer surface of the handle.

4. The manual and automatic integrated faucet according to claim 1, wherein the first action sensing element is an infrared sensing element, and the first action sensing element is arranged at the periphery of the water outlet of the water outlet component; and the second action sensing element is an infrared sensing element, and the second action sensing element is arranged on the outer side face of the water outlet component.

5. The manual and automatic integrated faucet according to claim 2, wherein the faucet also comprises a timer electrically connected with the control element; in the case that the electromagnetic valve is closed, when the control element receives the signal from the touch sensing element, the control element controls the opening of the electromagnetic valve and controls the timer to perform timing; and when the accumulative time of the timer reaches a set value, the timer feeds back a signal to the control element, which controls the closing of the electromagnetic valve, and at the same time the timer is automatically reset;

in the case that the electromagnetic valve is open, when the control element receives the touch signal from the touch sensing element, the control element controls the timer to be reset and restart timing; and when the accumulative time of the timer reaches a set value, the timer feeds back a signal to the control element, which controls the closing of the electromagnetic valve, and at the same time the timer is automatically reset.

6. The manual and automatic integrated faucet according to claim 5, wherein the control element receives the first trigger signal from the first infrared sensing element, and in the case that the electromagnetic valve is closed, the control element controls the electromagnetic valve to be opened, and at the same time controls the timer to perform timing; and when the accumulative time of the timer reaches a set value, the timer feeds back a signal to the control element, which controls the closing of the electromagnetic valve, and at the same time the timer is automatically reset;

in the case that the electromagnetic valve is open, when the control element receives the first trigger signal from the first infrared sensing element, the control element controls the timer to be reset and restart timing; and when the accumulative time of the timer reaches a set value, the timer feeds back a signal to the control element, which controls the closing of the electromagnetic valve, and at the same time the timer is automatically reset.

7. The manual and automatic integrated faucet according to claim 6, wherein when the second infrared sensing element senses that an object is entering the sensing area of the second infrared sensing element, the second infrared sensing element transmits a sensing signal to the control element; in the case that the electromagnetic valve is closed, the electromagnetic valve is controlled to be opened, and at the same time the timer is controlled to perform timing; and when the accumulative time of the timer reaches a set value, a signal is fed back to the control element, which controls the closing of the electromagnetic valve, and at the same time the timer is automatically reset.

8. The manual and automatic integrated faucet according to claim 7, wherein the displacement sensing element transmits the opening signal to the control element, and in the case that the electromagnetic valve is closed, the control element controls the opening of the electromagnetic valve, and at the same time the control element controls the timer to start timing; and when the timer reaches a set time, the timer feeds back information to the control element, which controls the closing of the electromagnetic valve, and the timer is automatically reset;

in the case that the electromagnetic valve is open, when the control element receives the opening signal from the displacement sensing element, the control element controls the timer to be reset and restart timing; and when a set time of the timer is reached, the timer feeds back information to the control element, which controls the closing of the electromagnetic valve, and at the same time the timer is automatically reset; in the case that the electromagnetic valve is open, when the control element receives the closing signal from the displacement sensing element, the control element directly controls the closing of the electromagnetic valve.

9. The manual and automatic integrated faucet according to claim 2, wherein the faucet also comprises a hose and a control line; the control line is electrically connected with the touch sensing element, the first infrared sensing element, the second infrared sensing element and the displacement sensing element respectively; and the control line is arranged inside the hose.

* * * * *